United States Patent [19]

Atkinson

[11] 4,179,134

[45] Dec. 18, 1979

[54] REMOVABLE TRAINER HANDLE AND BRAKE FOR SKATEBOARD

[76] Inventor: Wallace E. Atkinson, Rte. 3, Box 656, Petersburg, Va. 23803

[21] Appl. No.: 928,306

[22] Filed: Jul. 26, 1978

[51] Int. Cl.[2] ..... A63C 17/14

[52] U.S. Cl. ..... 280/87.04 A; 188/29; 280/11.2

[58] Field of Search ..... 280/87.04 A, 87.04 R, 280/11.2, 11.1 BT, 11.19; 188/22, 24, 29, 9, 20, 24, 19

[56] References Cited

U.S. PATENT DOCUMENTS

| | | | |
|---|---|---|---|
| 182,835 | 10/1876 | Lockwood | 280/11.2 |
| 1,070,468 | 8/1913 | Henley | 280/87.04 R |
| 1,213,454 | 1/1917 | Brown | 280/87.04 R |
| 1,253,768 | 1/1918 | Aman | 280/87.04 R |
| 1,530,165 | 3/1925 | Fowler | 280/87.04 A |
| 1,566,487 | 12/1925 | Letin | 280/87.04 R |
| 1,576,426 | 3/1926 | Griffin | 280/87.04 R |
| 1,890,755 | 12/1932 | Shepherd | 280/87.04 A |
| 2,027,254 | 1/1936 | Vogt | 280/87.04 R |
| 2,206,035 | 7/1940 | Hammond | 280/87.04 R |
| 2,330,147 | 9/1943 | Rodriguez | 280/87.04 R |
| 3,276,550 | 10/1966 | Honeyman | 188/29 |
| 3,385,608 | 5/1968 | Waddell | 280/87.04 A |
| 4,003,582 | 1/1977 | Maurer | 280/11.2 |
| 4,037,852 | 7/1977 | Bayer et al. | 280/87.04 A |
| 4,061,351 | 12/1977 | Bangle | 280/87.04 A |
| 4,084,831 | 4/1978 | Akonteh et al. | 280/11.2 |

*Primary Examiner*—David M. Mitchell

[57] ABSTRACT

A trainer handle and brake for removable attachment to a skateboard comprises a handle strut, a handle bar fastened to one end of the strut, a clamp secured at the other end of the strut for clamping the strut to the front end of a skateboard in upstanding relation thereto, the clamp having an upper jaw extending substantially perpendicular to the strut, a lower jaw underlying the upper jaw, and an actuator for moving the jaws together and apart for securing and releasing the jaws relative to the front end of the skateboard, a pair of brake shoes pivotally supported beneath the lower clamp jaw having ends adapted to overlie the front wheels of the skateboard, a lever arm connected to the brake shoes, a brake handle pivotally supported to the handle strut adjacent the handle bar, and brake operating linkage connecting the brake handle with the lever arm for pivoting the brake shoes against the top of the front wheels when the brake handle is actuated.

5 Claims, 3 Drawing Figures

REMOVABLE TRAINER HANDLE AND BRAKE FOR SKATEBOARD

BACKGROUND OF THE INVENTION

1. Field of the Invention

This invention relates to skateboards and in particular to a combined trainer handle and brake for removable attachment to a skateboard.

2. Description of the Prior Art

The current widespread interest in skateboards particularly among young people has resulted in the occurrence of many accidents, sometimes resulting in serious injuries. The safe use of a skateboard requires the development of considerable skill by the operator who has to learn how to maintain balance while travelling at sometimes high speeds and to guide the skateboard often in competition with motor vehicles using the same road or street.

This invention has been developed for the purpose of helping to reduce the risk of injury particularly to a beginner who is just learning how to use a skateboard. By providing a training handle and brake combination which may be removably attached to the front of the skateboard, the beginner is given a stabilizing support to help maintain balance and a brake which will permit the beginner to stop when necessary while learning to guide the skateboard out of the way of obstructions.

The following U.S. Pat. Nos. are representative of the prior art: 182,835; 1,213,454; 1,576,426; 2,027,254; 2,330,147; 4,003,582; 4,037,852; 4,061,351.

U.S. Pat. No. 4,061,351 discloses the broad concept of providing a removable handle for skateboards to be used by beginners and small children.

U.S. Pat. No. 1,576,426 discloses a handle attached to a coaster board by a U-shaped bracket which is bolted to the front of the coater board.

U.S. Pat. Nos. 182,835, 4,003,582, and 4,037,852 disclose brakes for skateboards and skates.

U.S. Pat. Nos. 1,213,454, 2,027,254 and 2,330,147 are illustrative of children's scooters which are customarily provided with handles but which do not have the combined handle and brake assembly of this invention.

The present invention distinguishes from the prior art of which applicant is aware by providing a trainer handle and brake combined in one unit, or assembly, which is removably attachable to the front end of a skateboard by means of a clamp.

SUMMARY OF THE INVENTION

It is therefore an object of this invention to provide a trainer handle and brake as a unitary assembly which may be readily attached to and detached from a skateboard of conventional design without any modification to the skateboard.

It is a further object of the invention to provide a trainer handle which may be adjusted in height to accommodate users of different heights.

It is still another object of this invention to provide a trainer handle which is secured to a skateboard by a clamp which includes a pair of jaws for engaging the skateboard along its top and bottom surfaces.

It is still another object of the invention to provide a trainer handle and brake assembly in which the brake shoes are pivoted to the lower jaw of the clamp which secures the assembly to the skateboard with the shoes overlying the front wheels of the skateboard.

It is still another object of the invention to provide brake shoes which are part of an adjustable brake plate assembly, the shoes being adjustable laterally to vary the spacing between the shoes.

BRIEF DESCRIPTION OF THE DRAWING

With the foregoing more important objects and features in view and such other objects and features which may become apparent as this specification proceeds; the invention will be understood from the following description taken in conjunction with the accompanying drawing, in which like characters of reference are used to designate like parts, and in which.

Figure 1:
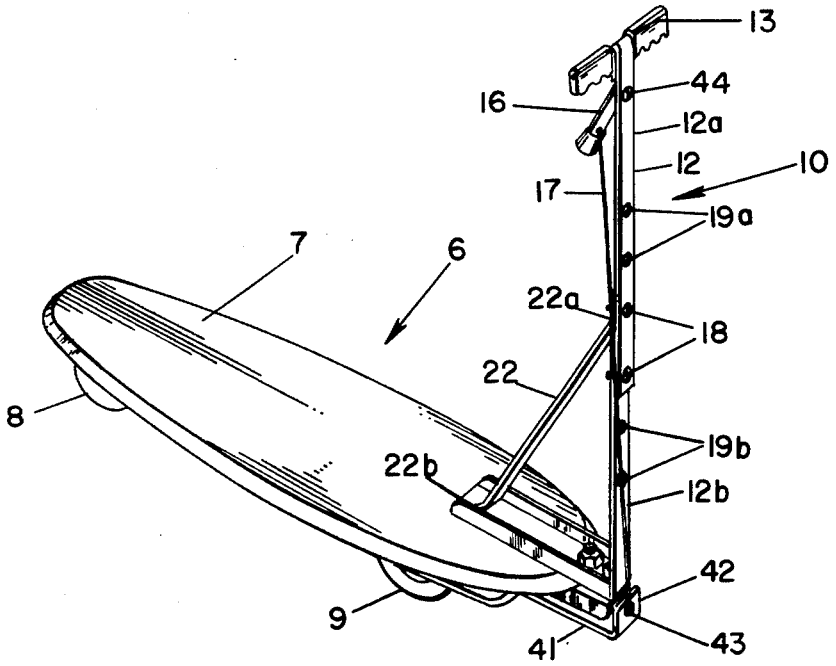
FIG. 1 is a perspective view showing a skate board and a combined trainer handle and brake assembly in accordance with a preferred embodiment of this invention mounted thereon.

Referring to the drawing, the trainer handle and brake assembly of the present invention is generally indicated at 10 and is shown in FIG. 1 attached to a skateboard 6 of conventional construction. The skateboard 6 comprises an elongated platform 7 which is rounded at opposite ends and is supported by sets 8 and 9 of small wheels adjacent the opposite ends of the platform.

Figure 2:
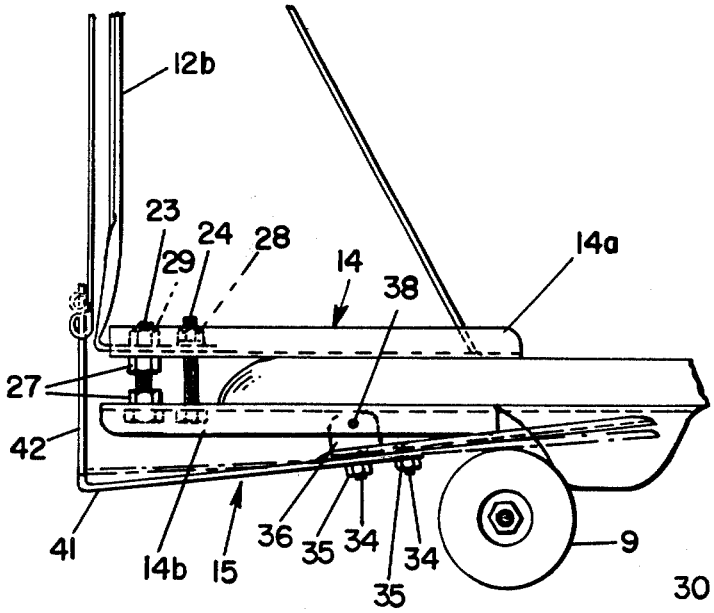
FIG. 2 is a partial side elevational view showing the lower portion of the trainer handle and brake assembly mounted on the front portion of a skate board.

The invention 10 comprises a handle strut 12 having a handle bar 13 secured across its upper end, and a clamp 14 secured at its lower end for clamping the handle strut to the front end of a skate board as seen in FIGS. 1 and 2. A brake 15 is pivotally secured beneath the clamp 14 for engagement with the front wheels 9 of the skateboard.

The handle strut includes upper and lower sections **12*a* and 12*b* whose adjacent ends overlap and are secured together by a pair of bolts 18. The handle strut sections 12*a* and 12*b* have a plurality of equally spaced holes 19*a* and 19*b* respectively therein through which the bolts 18 are selectively placed in order to adjust the length of the handle strut. The lower end of the handle strut section 12*b* is bent rearwardly approximately perpendicular to the major portion of the strut section 12*b* to provide a short right angle extension 20 having a pair of apertures 21** therein.

The clamp 14 comprises channel shaped upper and lower jaws **14*a* and 14*b*, each having a pair of parallel legs 14',14' and a connecting web 14''. The short extension 20 of the handle strut 12*b* is secured to one end of the upper jaw 14*a* preferably by spot welding the extension to the web 14'' between the legs 14', 14' of the jaw. A diagonal brace 21 having short angular extensions 22*a* and 22*b* is connected by its upper extension 22*a* to the rear of the handle strut 12 by means of the upper bolt 18 and is connected by its lower extension 22*b* to the end of the upper jaw 14*a* opposite the end receiving handle strut extension 20 by spot welding. The lower clamp jaw 14*b* is adjustably secured to the upper jaw 14*a* by a pair of bolts 23 and 24 extending through spaced holes 25,25 in the lower jaw and correspondingly spaced holes 21,21 in the upper jaw. The bolts 23 and 24 are inserted from beneath the lower jaw so that their hexagonal heads bear against the underside of the lower jaw, and their threaded shanks extend upwardly through the aligned holes 25 and 21. A washer 26 is interposed between the head of the bolt 23 and the web 14'' of the lower jaw, and a pair of nuts 27,27 are threaded onto the shank of the bolt 23 between the two jaws as seen in FIG. 2. The nuts 27 can be screwed together or apart to adjust the space between the jaws 14*a* and 14*b* to the approximate thickness of the skateboard. A washer 26 and a nut 28 are placed on the upper end of the bolt 24, and the nut 28 is turned to move the upper and lower jaws 14*a*,14*b* together to tighten the clamp 14 against the front end of the skate board as seen in FIG. 2. A nut 29 may also be placed on the end of the bolt 23 above the upper jaw 14*a*** and tightened.

The brake 15 includes a pair of L-shaped brake plates having overlapping adjacent ends **30*a* and 31*a* respectively, and parallel flat extensions 30*b* and 31*b* which function as brake shoes. A pair of holes 32,32 are provided in the brake plate end 30*a*, and a pair of elongated slots 33 are provided in the brake plate end 31*a*. A pair of bolts 34 are inserted through the slots 33 and holes 32 from above, and are secured by nuts 35 from beneath the brake plates. The parallel slots 33 provide means for adjusting the space between the brake shoes 30*b* and 31*b* to the distance between the wheels of the front wheel set 9 so that the brake shoes will overlie the tops of the wheels. A U-shaped pivot clevis 36 is secured on top of the brake plates 30,31 by one of the bolts 34 extending through an aperture 37 therein. The clevis 36 is pivotally connected to the lower jaw 14*b* of the clamp 14 by a pivot pin 38 which extends through aligned holes 39 in the upstanding legs of the clevis 36 and through aligned holes 40 (only one shown) in the depending legs 14' of the channel shaped lower jaw 14*b*. A lever arm 41 is connected beneath the brake plates 30,31 by the bolts 34,34, and it extends parallel to and opposite from the brake shoes 30*b* and 31*b*. The lever arm 41 has an upturned end portion 42 with a hole 43 therein for receiving one end of a connecting rod 17**.

The brake 15 is actuated by a brake handle 16 which is pivotally connected adjacent one end to the upper handle strut section **12*a* beneath the handle bar 13 by a pivot pin 44. The brake handle 16 is connected to the brake lever arm by the connecting rod 17**.

In use, the trainer handle and brake assembly 10 is removably attached to the front end of a skateboard as shown in FIGS. 1 and 2 by inserting the front rounded end of the platform 7 between the upper and lower jaws **14*a* and 14*b* of the clamp 14. The clamp is then tightened by tightening the nut 28 on the bolt 24. The brake shoes 30 and 31 are adjusted by loosening the nuts 35 on the bolt 34, and sliding the plates relative to each other until the brake shoes 30*b* and 31*b* are parallel and overlie the tops of the wheels of wheel set 9, whereupon the nuts 35 are tightened on the bolts 34 to lock the brake plates in adjusted position. The length of the handle strut 12 is also adjusted to suit the user of the skateboard by removing the bolts 18, sliding the upper and lower strut sections 12*a* and 12*b* closer together or farther apart as the case may be and reinserting the bolts 18 through overlaping ends of the strut sections 12*a* and 12*b***.

The handle 12 with its handle bar 13 provides support for the person who is learning to use the skateboard to which it is attached, and provides the person with a sense of balance. The brake 15 which is easily actuated by pulling up on the handle 16 provides the operator with means to stop for obstructions. The upward movement of the brake handle 16 lifts the forward end of the brake lever 41 and moves the brake shoes **30*b* and 31*b* down against the wheels of the wheel set 9. The friction of the brake shoes on the wheels 9** will brake the wheels and slow or stop the skateboard depending upon the braking force exerted by the operator.

The position of the clevis 36 and the distribution of the weight of the brake plates 30,31, the lever arm 41 and connected parts is such that when the brake handle 16 is released, the brake handle will pivot downwardly under its own weight and the brake shoes **30*b* and 31*b* will be lifted out of engagement with the front skate wheel 9**.

Figure 3:
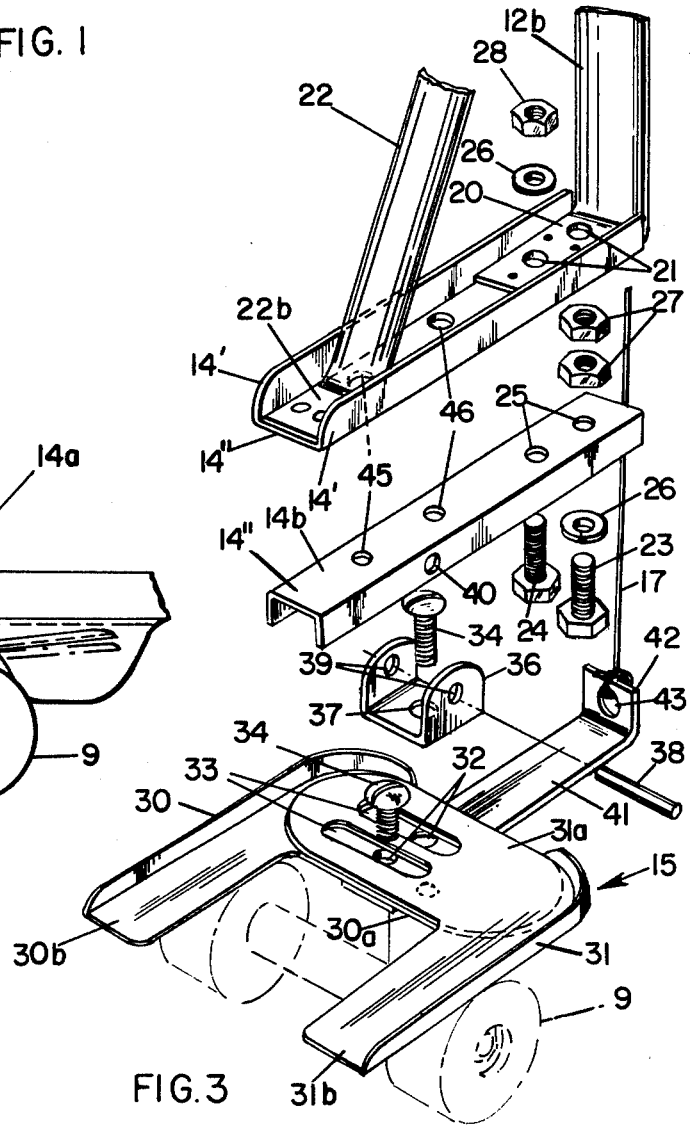
FIG. 3 is an exploded perspective view on an enlarged scale showing the lower portion of the trainer handle and brake assembly with the brake positioned above the skate board's front wheels (shown in phantom).

Looking at FIG. 3, the two sets of aligned holes 45 and 46 in the clamp jaws **14*a* and 14*b* are provided so that optionally the trainer handle and brake assembly may be more permanently secured to the skateboard 6 by drilling holes in the skateboard to match the holes 45 and 46 in the clamp jaws and bolting the jaws to the skateboard by inserting bolts through the holes 45 and 46** and the matched holes drilled in the skateboard.

While in the foregoing there has been described and shown a preferred embodiment of the invention, various modifications and equivalents may be resorted to within the spirit and scope of the invention as claimed.

What is claimed is:

1. The combination of a trainer handle and brake for removable attachment to a skateboard and the like, the skateboard having transversely spaced front and rear wheel sets comprising:

a handle strut;

a handle bar fastened to one end of said strut;

clamping means secured at the other end of said strut for clamping said strut to the front end of a skateboard in upstanding relation thereto, said clamping means including an upper jaw extending substantially perpendicular to said strut, a lower jaw underlying said upper jaw, and means for moving said jaws together and apart for attaching and detaching said clamping means relative to the front end of the skateboard;

a pair of transversely spaced brake shoes, means pivotally supporting said spaced brake shoes beneath the lower jaw of said clamp to overlie the front wheels of the skateboard;

a lever arm connected to said brake shoes;

a brake handle pivotally supported on said handle strut adjacent said handle; and brake operating linkage means connecting said brake handle with said lever arm for pivoting said brake shoes against the top of said front wheel set when said brake handle is actuated from a normal position and for disengaging said brake shoes from said front wheel set when said brake handle is released, said upper and lower jaws being elongated channel members the upper jaw channel member being open in the upper direction and the lower jaw channel member being open in the downward direction, the end of said strut to which the clamping means is secured having a rigid right angle extension secured in one end of said upper jaw channel member and said brace having a base portion secured in the other end of said upper channel member from said right angle extension.

2. The combination of claim 1 whereas said handle strut is adjustable in length, said handle strut including an upper section and a lower section, said upper and lower sections having overlapping adjacent ends, and means for securing the overlapping ends of said upper and lower ends together with adjacent ends overlapping and spaced apart by different predetermined and selected distances.

3. The combination of claim 1 together with an angled brace extending between said handle strut and said upper jaw of said clamp.

4. The combination of claim 1 wherein said handle bar extends transversely across said one end of said handle strut and is secured to said strut medially between opposite ends of said handle bar.

5. The combination of a trainer handle and brake for removable attachment to a skateboard and the like, the skateboard having transversely spaced front and rear wheel sets comprising:

a handle strut;

a handle bar fastened to one end of said strut;

clamping means secured at the other end of said strut for clamping said strut to the front end of a skateboard in upstanding relation thereto, said clamping means including an upper jaw extending substantially perpendicular to said strut, a lower jaw underlying said upper jaw, and means for moving said jaws together and apart for attaching and detaching said clamping means relative to the front end of the skateboard;

a pair of transversely spaced brake shoes, means pivotally supporting said spaced brake shoes beneath the lower jaw of said clamp to overlie the front wheels of the skateboard;

a lever arm connected to said brake shoes;

a brake handle pivotally supported on said handle strut adjacent said handle; and brake operating linkage means connecting said brake handle with said lever arm for pivoting said brake shoes against the top of said front wheel set when said brake handle is actuated from a normal position and for disengaging said brake shoes from said front wheel set when said brake handle is released, said brake shoes being integral parts of a pair of L-shaped brake plates, the plates having overlapping adjacent ends, and means for laterally adjusting the brake plates to vary the spacing between said brake shoes.

* * * * *